US009520084B2

(12) United States Patent
Yu et al.

(10) Patent No.: US 9,520,084 B2
(45) Date of Patent: Dec. 13, 2016

(54) IMAGE QUALITY COMPENSATION DEVICE AND METHOD FOR ORGANIC LIGHT EMITTING DISPLAY

(71) Applicant: LG DISPLAY CO., LTD., Seoul (KR)

(72) Inventors: Sangho Yu, Paju-si (KR); Seungtae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 398 days.

(21) Appl. No.: 14/132,783

(22) Filed: Dec. 18, 2013

(65) Prior Publication Data

US 2015/0062137 A1 Mar. 5, 2015

(30) Foreign Application Priority Data

Aug. 30, 2013 (KR) ..... 10-2013-0104341

(51) Int. Cl.
*G09G 3/3233* (2016.01)
*G09G 3/32* (2016.01)

(52) U.S. Cl.
CPC .... *G09G 3/3233* (2013.01); *G09G 2300/0842* (2013.01); *G09G 2320/0233* (2013.01); *G09G 2320/0295* (2013.01); *G09G 2320/043* (2013.01)

(58) Field of Classification Search
CPC . G06T 1/60; G09G 3/3233; G09G 2300/0842; G09G 2320/043; G09G 2320/0295; G09G 2320/0233
USPC ..... 345/531, 212, 690, 39, 44–46, 55, 63,345/76–82, 92; 313/498–500
See application file for complete search history.

(56) References Cited

U.S. PATENT DOCUMENTS 7,439,941 B1 * 10/2008 Kumakura ..... G09G 3/2944 345/60
7,839,368 B2 * 11/2010 Chen ..... G09G 3/3611 345/690
8,339,427 B2 * 12/2012 Shirasaki ..... G09G 3/3233 345/690
8,379,041 B2 * 2/2013 Chen ..... G09G 3/20 345/204
8,558,825 B2 * 10/2013 Bae ..... G09G 3/3233 315/169.3
2007/0126975 A1 * 6/2007 Choi ..... G02F 1/1309 349/192
2008/0100545 A1 * 5/2008 Hong ..... G09G 3/325 345/82

(Continued)

*Primary Examiner* — Kumar Patel
*Assistant Examiner* — Vinh Lam
(74) *Attorney, Agent, or Firm* — Birch, Stewart, Kolasch & Birch, LLP

(57) ABSTRACT

An image quality compensation device for an organic light emitting display includes: a memory having first and second update blocks selectively storing first and second period compensation values, which are sequentially updated at regular intervals; and a timing controller that configures the first update block as either the current memory page for data loading or the next memory page for data writing and the second update block as the other one of the two, based on a preset check code, and updates the memory by calculating the second period compensation value with the passage of driving time based on the first period compensation value loaded from the update block configured as the current memory page, writing the second period compensation value to the update block configured as the next memory page, and then erasing the first period compensation value from the update block configured as the current memory page.

21 Claims, 8 Drawing Sheets

(56) References Cited

U.S. PATENT DOCUMENTS

| | | | | |
|---|---|---|---|---|
| 2008/0284691 | A1* | 11/2008 | Chung | G09G 3/3291 345/76 |
| 2010/0134469 | A1* | 6/2010 | Ogura | G09G 3/3291 345/211 |
| 2010/0225656 | A1* | 9/2010 | Kim | G06F 9/30149 345/522 |
| 2011/0063312 | A1* | 3/2011 | Hong | G06T 1/60 345/530 |
| 2014/0118241 | A1* | 5/2014 | Chai | G06F 3/0418 345/156 |

* cited by examiner

IMAGE QUALITY COMPENSATION DEVICE AND METHOD FOR ORGANIC LIGHT EMITTING DISPLAY

This application claims the benefit of Korean Patent Application No. 10-2013-0104341 filed on Aug. 30, 2013, which is incorporated herein by reference for all purposes as if fully set forth herein.

BACKGROUND

Field

This document relates to an active matrix type organic light emitting display, and more particularly, to an image quality compensation device and method for an organic light emitting display, which compensate for deterioration with the passage of driving time.

Related Art

An active matrix type organic light emitting display comprises a self-luminous organic light emitting diode (hereinafter, referred to as "OLED"), and has advantages such as fast response speed, high light emission efficiency, high luminance, and wide viewing angle.

The OLED, a self-luminous element, comprises an anode, a cathode, and an organic compound layer HIL, HTL, EML, ETL, and EIL formed between the anode and the cathode. The organic compound layers consists of a hole injection layer HIL, a hole transport layer HTL, an emission layer EML, an electron transport layer ETL, and an electron injection layer EIL. If a driving voltage is applied to the anode and the cathode, holes which have passed through the hole transport layer HTL and electrons which have passed through the electron transport layer ETL move to the emission layer EML and form excitons; and as a result, the emission layer EML generates visible light.

The organic light emitting display arranges pixels in a matrix form, each pixel comprising an OLED and a driving thin film transistor (TFT) controlling the driving current flowing through the OLED, and adjusts the luminance of the pixels according to the gray level of video data. The luminance of a pixel is proportional to the magnitude of the driving current flowing through the OLED, and this driving current is dependent on the electrical characteristics of the driving TFT.

Although it is preferable that the driving TFT's electrical characteristics such as threshold voltage, mobility, etc are the same for all pixels, they differ slightly from pixel to pixel due to many causes in reality. Differences in the driving TFT's electrical characteristics cause luminance differences between the pixels.

A variety of compensation methods for compensating for differences in the driving TFT's electrical characteristics are known. The compensation methods are categorized into internal compensation methods and external compensation methods. In an internal compensation method, threshold voltage differences between the driving TFTs are automatically compensated for within a pixel circuit. It is necessary that the driving current flowing through the OLED is determined regardless of the threshold voltage of the driving TFT for internal compensation, thus making the configuration of the pixel circuit rather complicated. Moreover, the internal compensation method is inappropriate to compensate for mobility differences between the driving TFTs.

In an outer compensation method, sensed voltages corresponding to the threshold voltage (or mobility) of the driving TFTs are measured, and an external circuit modulates video data based on these sensed voltages to compensate for threshold voltage (or mobility) differences. In other words, the external compensation method is to derive a compensation value for compensating for differences in electrical characteristics between the driving TFTs before product shipment, store it as initial compensation data in a nonvolatile memory, modulate input digital video data based on the initial compensation data stored in the memory at the time of normal driving after product shipment, and compensate for luminance differences caused by the differences in electrical characteristics between the driving TFTs.

This external compensation method cannot cope with deterioration with the passage of driving time because the organic light emitting display is driven only with the initial compensation data even after product shipment, and the organic light emitting display is therefore susceptible to afterimages. Accordingly, an improved external compensation method has been recently proposed to update compensation data by sensing driving TFT deterioration occurring after shipment again. However, this improved external compensation method also has the following problems.

First, the prior art improved external compensation method does not include a process of checking for errors in compensation data obtained by an update operation. If an abnormal power-off situation such as a blackout occurs during the update process, the compensation data to be stored in a memory is not normal. As such abnormal compensation data serves as a basis for subsequent compensation—modulated video data is applied to pixels in accordance with abnormal compensation data, deteriorated values of the pixels are sensed, with the modulated video data being applied to the pixels, and a new compensation value is derived from the sensed deteriorated values), the quality level of images in a subsequent driving operation is significantly decreased.

Second, the prior art improved external compensation method does not include an additional component for preventing abnormal data from being stored in a memory when compensation data is distorted due to the instability of driving power. The abnormal data decreases the accuracy of a subsequent compensation operation and the quality level of images.

This creates a demand for a new external compensation method which increases compensation capability.

SUMMARY

The present invention has been made in an effort to provide an image quality compensation device and method for an organic light emitting display which increase compensation capability.

In one aspect, the present invention provides an image quality compensation device for an organic light emitting display, the device comprising: a memory having first and second update blocks for selectively storing first and second period compensation values, which are sequentially updated at regular intervals; and a timing controller that configures the first update block as either the current memory page for data loading or the next memory page for data writing and the second update block as the other one of the two, based on a preset check code, and updates the memory by calculating the second period compensation value with the passage of driving time based on the first period compensation value loaded from the update block configured as the current memory page, writing the second period compensation value to the update block configured as the next memory page, and then erasing the first period compensation value from the update block configured as the current memory page.

In another aspect, the present invention provides an image quality compensation method for an organic light emitting display, the method comprising: preparing a memory having first and second update blocks for selectively storing first and second period compensation values, which are sequentially updated at regular intervals; configuring the first update block as either the current memory page for data loading or the next memory page for data writing and the second update block as the other one of the two, based on a preset check code; and updating the memory by calculating the second period compensation value with the passage of driving time based on the first period compensation value loaded from the update block configured as the current memory page, writing the second period compensation value to the update block configured as the next memory page, and then erasing the first period compensation value from the update block configured as the current memory page.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, exemplary embodiments of the present invention will be described with reference to FIGS. 1 to 10*b*.

Figure 1:
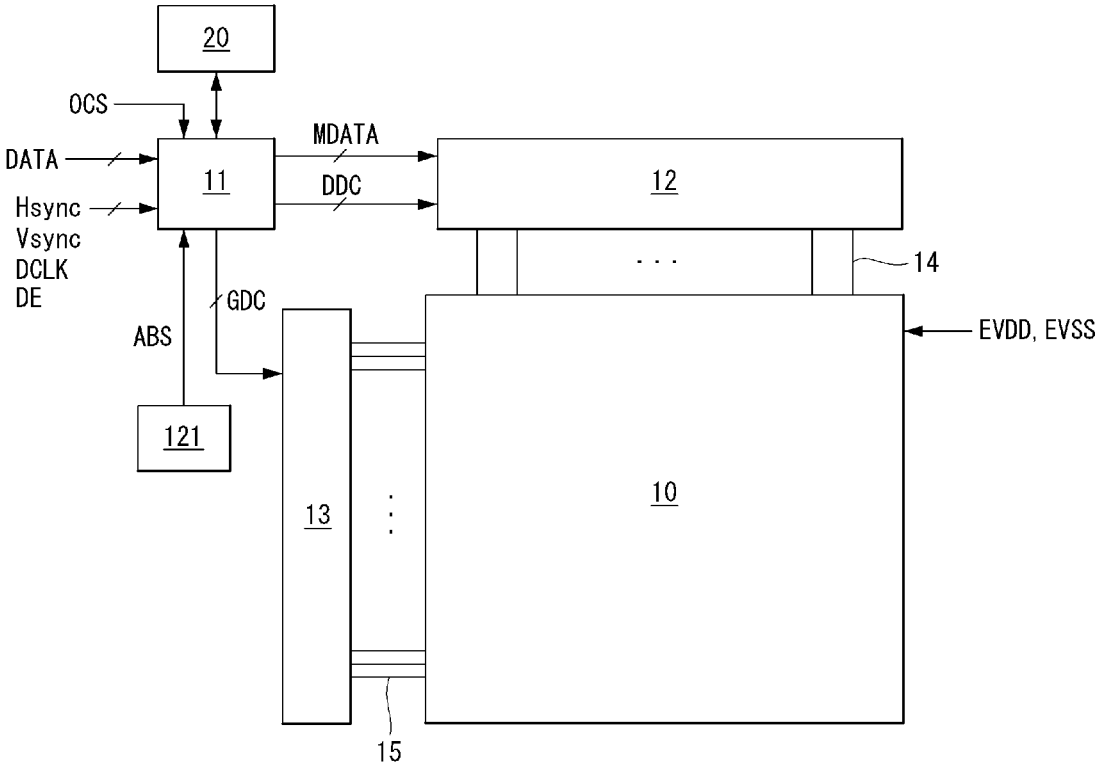
FIG. 1 is a view showing an organic light emitting display according to an exemplary embodiment of the present invention.
Figure 2:
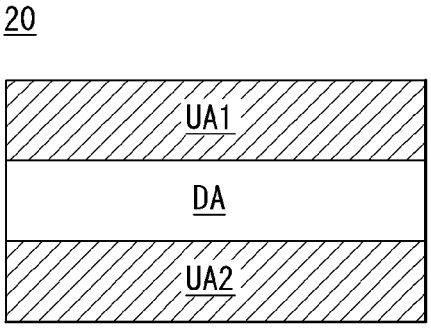
FIG. 2 is a view showing the configuration of a memory according to an exemplary embodiment of the present invention.

FIG. 1 schematically shows an organic light emitting display to which an image quality compensation device and method according to the present invention are applied.

Referring to FIG. 1, an organic light emitting display according to an exemplary embodiment of the present invention comprises a display panel 10 having pixels arranged in a matrix form, a data drive circuit 12 for driving data signal lines 14, a gate drive circuit 13 for driving gate signal lines 15, a timing controller 11 for controlling the operation timing of the data drive circuit 12 and gate drive circuit 13, a memory 20 for storing a compensation value for compensating for luminance differences between the pixels. And a driving voltage sensing unit 121 for sensing a high-potential driving voltage applied to the pixels.

Figure 7:
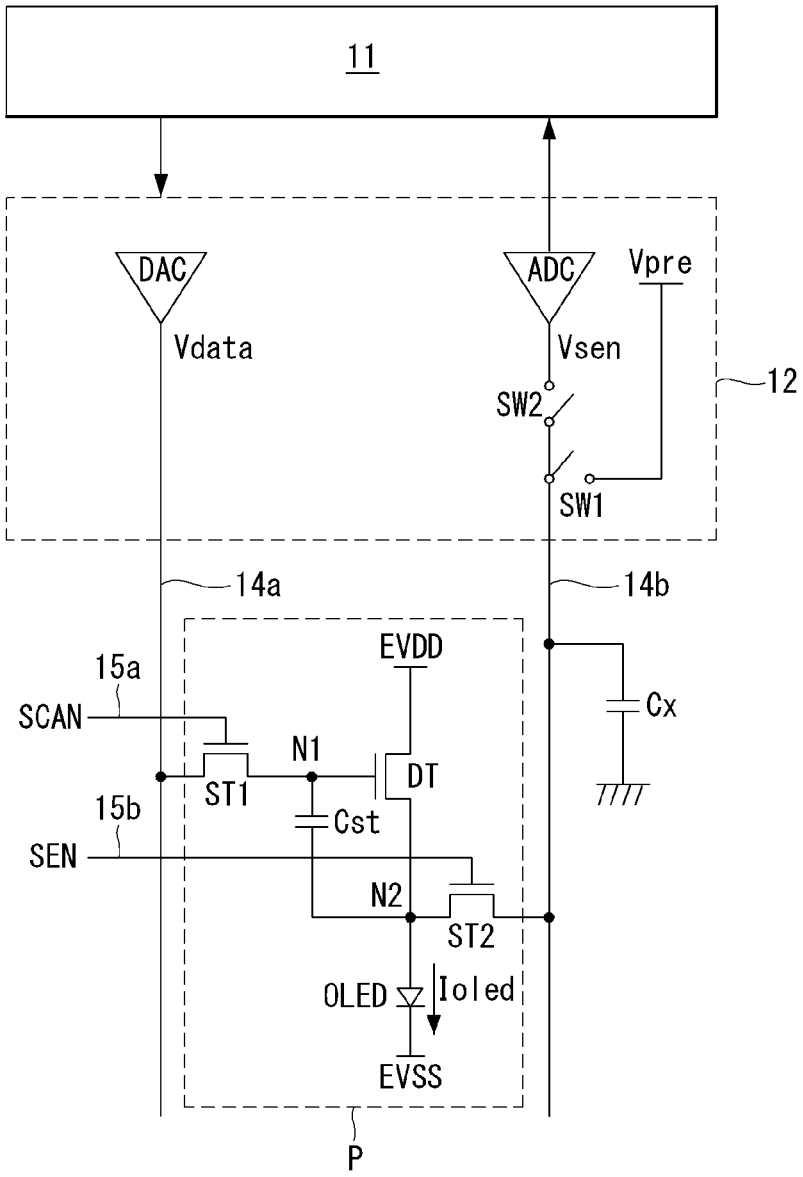
FIG. 7 is a view showing a connection structure between a timing controller, a data drive circuit, and a pixel.

A plurality of data signal lines 14 and a plurality of gate signal lines 15 intersect each other on the display panel 10, and pixels are arranged in a matrix form at each intersection block between the data signal lines 14 and the gate signal lines 15. As illustrated in FIG. 7, each data signal line 14 may comprise a data voltage supply line 14*a* and a sensed voltage supply line 14*b*, and each gate signal line 15 may comprise a scan control line 15*a* and a sensing control line 15*b*. Each pixel P comprises an OLED, a driving TFT DT, etc, and the data voltage supply line 14*a* and the sensed voltage supply line 14*b* can be connected to the scan control line 15*a* and the sensing control line 15*b*. Each pixel P is supplied with a high-potential driving voltage EVDD and a low-potential driving voltage EVSS from a power generator (not shown). The TFTs constituting the pixels P may be implemented as n-type or p-type. Also, a semiconductor layer for the TFTs constituting the pixels P may comprise amorphous silicon, polysilicon, or an oxide.

As shown in FIG. 7, the data drive circuit 12 converts digital compensation data MDATA input from the timing controller 11 into an analog data voltage based on a data control signal DDC, and supplies the analog data voltage to the data voltage supply lines 14*a*. On compensated driving, the data driving circuit 12 converts sensed voltages Vsen input from the display panel 10 through the sensed voltage supply lines 14*b* into digital values, and supplies the digital values to the timing controller 11.

As shown in FIG. 7, the gate drive circuit 13 generates a scan signal SCAN and a sensing signal SEN based on a gate control signal GDC. Also, the gate drive circuit 13 supplies the scan signal SCAN to the scan control lines 15*a* in a line sequential manner, and supplies the sensing signal SEN to the sensing control lines 15*b*. The gate drive circuit 13 can be formed directly on the display panel 10 in a Gate-driver In Panel (GIP) manner.

The timing controller 11 modulates input digital video data DATA based on a compensation value loaded from the memory 20 to generate digital compensation data MDATA for compensating the threshold voltage (and/or mobility) of the driving TFTs. The timing controller 11 aligns digital compensation data MDATA in accordance with the resolution of the display panel 10 and supplies it to the data drive circuit 12. The timing controller 11 generates a data control signal DDC for controlling the operation timing of the data drive circuit 14 and a gate control signal GDC for controlling the operation timing of the gate drive circuit 15 based on timing signals such as a vertical synchronization signal Vsync, a horizontal synchronization signal Hsync, a dot clock signal DCLK, and a data enable signal DE.

The timing controller 11 compares the data values for particular positions in first and second update blocks with a preset check code and controls the memory 20 so as to load only normal compensation data. The timing controller 11 calculates a new compensation value by deriving a shift value with the passage of driving time with reference to the electrical characteristic values of the driving TFTs sensed by the data drive circuit 12 and adding the shift value to an initial compensation value.

When an abnormal signal ABS is input from the driving voltage sensing unit 121, the timing controller 11 controls the data write address to prevent abnormal data from being stored in the memory 20.

The memory 20 stores the compensation value for compensating for differences in electrical characteristics between the driving TFTs formed in the pixels. The memory 20 comprises update blocks UA1 and UA2 for storing a compensation value, which is updated at regular intervals after product shipment and an initial value storing block DA for storing the initial compensation value preset before product shipment. In the present invention, the update block UA1 and UA2 is divided into a first update block UA1 and a second update block UA2 so as to increase device reliability and easily prevent the loading of abnormal compensation data. The first update block UA1 and the second update block UA2 selectively store a first period compensation value and a second period compensation value, which are sequentially updated at the regular intervals. In the present invention, the data values for particular positions in the first and second update blocks are compared with a preset check code, and only normal compensation data is loaded and used for image representation and subsequent compensation.

Figure 3:
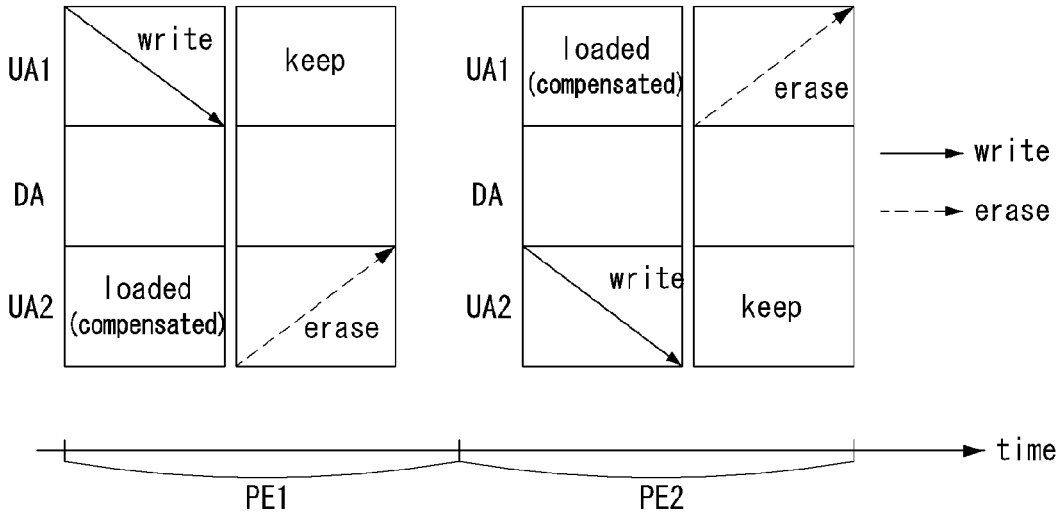
FIG. 3 is a view showing the memory's data writing and loading operations.
Figure 4:
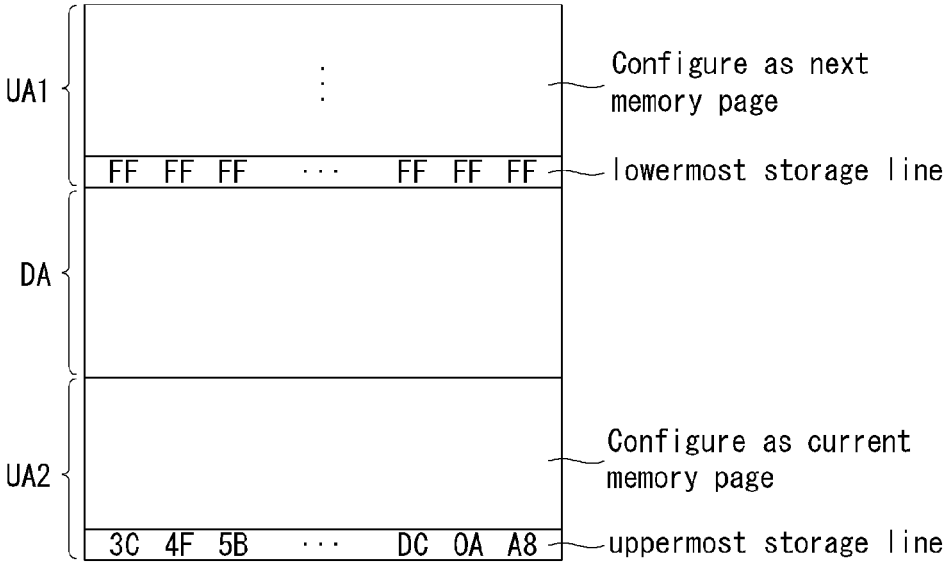
FIG. 4 is a view showing an example of the data values for particular positions in update blocks which are compared with a preset check code.
Figure 5:
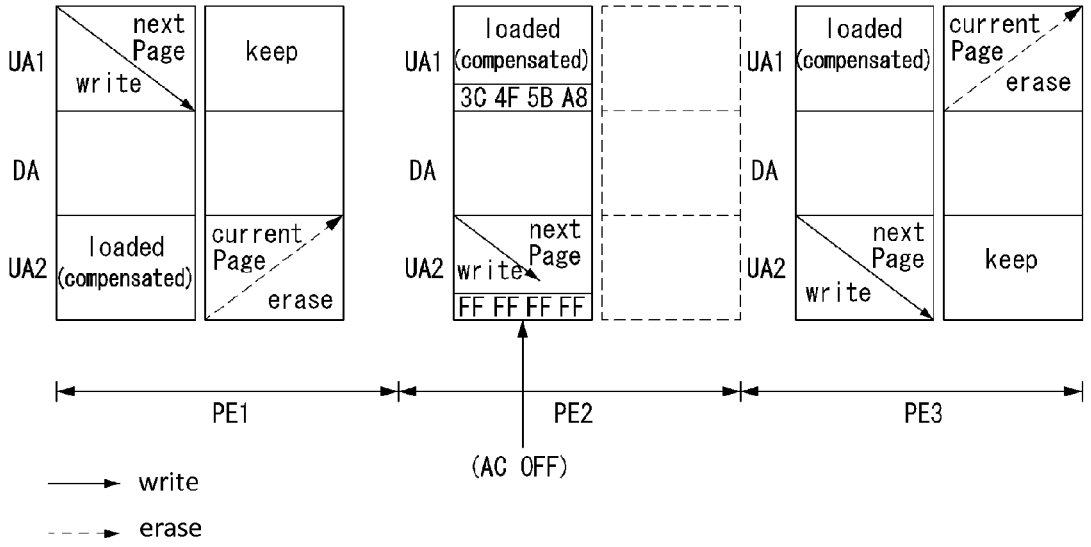
FIG. 5 is a view showing a memory operation when the power turns off abnormally.

FIG. 3 shows the memory's data writing and loading operations, and FIG. 4 shows an example of the data values for particular positions in update blocks which are compared with a preset check code. FIG. 5 shows a memory operation when the power turns off abnormally.

Referring to FIGS. 3 and 4, based on a preset check code, the timing controller 11 configures the first update block UA1 as either the current memory page for data loading or the next memory page for data writing and the second update block UA2 as the other one of the two. In other words, the timing controller 11 compares the data values for particular positions in the first and second update blocks UA1 and UA2 with the check code, and configures the update block in which a particular position has the same data value as the check code to be the next memory page and configures the update block in which a particular position has a different data value from the check code to be the current memory page.

The check code may be set to 'FF', and 'FF' indicates an initialization result value of a data erasing operation. Storage line in which data is written for the last time in the first and second update blocks UA1 and UA2 may be selected as the particular positions. As the data writing order and the data erasing order are opposite in the first and second update blocks UA1 and UA2, the current memory page and the next memory page can be configured more easily.

For example, in the first update block UA1 and the second update block UA2, data is written from the uppermost storage line toward the lowermost storage line, and data is erased from the lowermost storage line toward the uppermost storage line. In the first and second update blocks UA1 and UA2, the particular positions indicate the lowermost storage lines, as shown in FIG. 4.

When a new second period compensation value is calculated based on a first period compensation value loaded from the update block configured as the current memory page, the timing controller 11 writes the new second period compensation value in the update block configured as the next memory page and erases the first period compensation value from the update block configured as the current memory page.

In other words, as shown in FIGS. 3 and 4, if the first update block UA1 and the second update block UA2 are configured as the next memory page and the current memory page, respectively, in a first period PE1, the timing controller 11 calculates a second period compensation value based on the first period compensation value loaded from the second update block UA2 and writes it in the first update block UA1, and then erases the first period compensation value from the second update block.

Accordingly, the first update block UA1 and the second update block UA2 are configured as the current memory page and the next memory page, respectively, in a second period PE2 subsequent to the first period PE1. In the second period PE2, data is written and erased the other way around from in the first period PE1. That is, the timing controller 11 calculates a third period compensation value based on the second period compensation value loaded from the first update block UA1 and writes it in the second update block UA2, and then erases the second period compensation value from the first update block UA1.

FIG. 5 shows a memory operation when power turns off abnormally.

Referring to FIG. 5, the timing controller 11 configures the first update block UA1 and the second update block UA2 as the current memory page and the next memory page, respectively, in the second period PE2, and then calculates a third period compensation value based on the second period compensation value loaded from the first update block UA1. However, if an abnormal power-off situation AC OFF such as a blackout occurs while the third period compensation value calculated in the second period PE2 is being written to the second update block UA2, the lowermost storage line in which data is written for the last time in the second update block UA2 has the 'FF' value indicating an initialization result value in a first period PE1. In the first update block UA1, the second period compensation value is not erased but kept as it is.

In this state, when a third period PE3 comes, the timing controller 11 re-configures the second update block having the data value 'FF' for the lowermost storage line as the next memory page, and re-configures the first update block UA1 having a data value other than 'FF' for the lowermost storage line as the current memory page. Then, the timing controller 11 preliminarily erases an abnormal compensation value from the second update block UA2 before re-writing the third period compensation value in the second update block UA2 re-configured as the next memory page, thereby further improving the accuracy of compensation. Once the abnormal compensation value is erased from the second update block UA2, the timing controller 11 likewise updates the second update block UA2 and erases the first update block UA1.

As the data values for particular positions in the first and second update blocks UA1 and UA2' are compared with a preset check code and only normal compensation data is loaded, the present invention can avoid the problem that subsequent compensation becomes inaccurate due to the loading of abnormal compensation data and the quality of images is therefore degraded.

Figure 6:
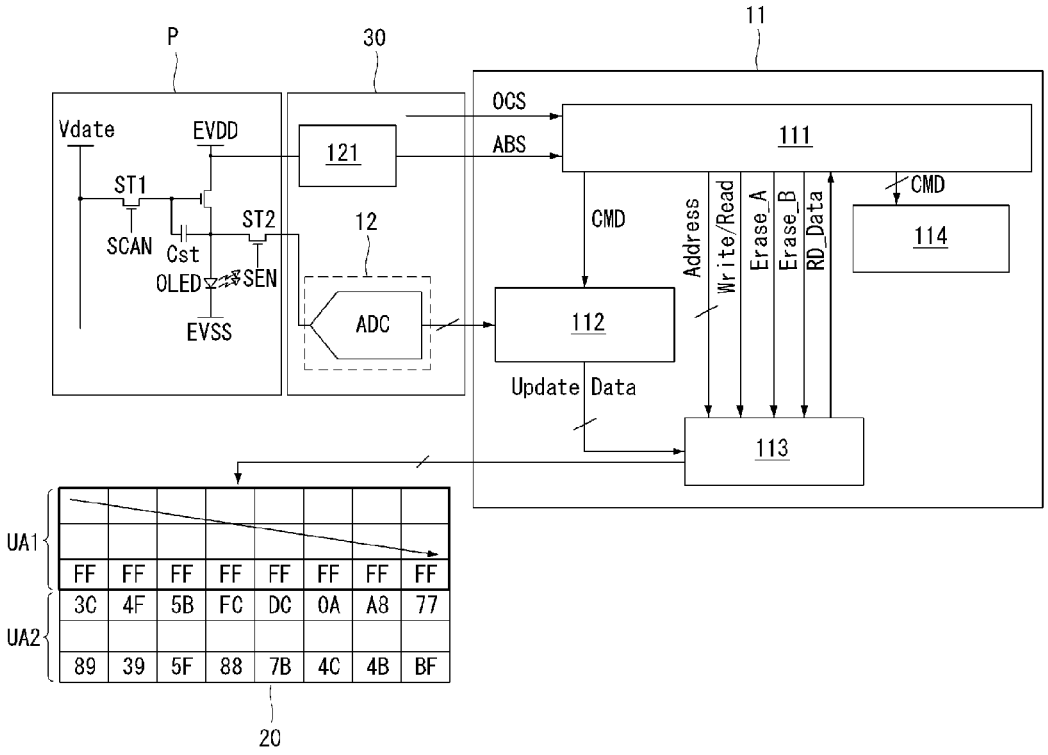
FIG. 6 is a view showing one configuration of an image quality compensation device according to the present invention.

FIG. 6 shows one configuration of an image quality compensation device according to the present invention.

Referring to FIG. 6, the image quality compensation device of this invention comprises a pixel P, a source PCB 30, a timing controller 11, and a memory 20.

A detailed connection configuration of the pixel P will be described later with reference to FIG. 7.

The source PCB 30 supplies an off compensation signal OCS input form a host system (not shown) to the timing controller 11. The off compensation signal OCS is activated at regular intervals, and once the off compensation signal OCS is activated, a data update operation is performed on the memory 20.

The data drive circuit 12 and the driving voltage sensing unit 121 are mounted on the source PCB 30. The data drive circuit 12 converts digital video compensation data input from the timing controller 11 into a compensated data voltage, applies the compensated data voltage to the pixel P of the display panel, senses the electrical characteristic value of the driving TFT of the pixel P, analog-to-digital converts the sensed value through an ADC, and supplies it to the timing controller 11. The driving voltage sensing unit 121 senses the voltage of a high-potential driving voltage input terminal that supplies operating power to the pixel P, and if the high-potential driving voltage EVDD drops to or below than a specified value, outputs an abnormal signal to the timing controller 11.

The timing controller 11 comprises a compensation controller 111, a compensation value calculator 112, a memory controller 113, and a compensation control signal generator 114.

The compensation controller 111 controls overall operations related to compensation. The compensation controller 111 enables compensation data to be written to, erased from, and loaded on the memory 20 by controlling the operation of the memory controller 113 using an address indicator signal, a write/read indicator signal, an erasing_A/B indicator signal, a compensation value loading (RD_Data) indicator signal, etc. Also, the compensation controller 111 modulates input digital video data DATA based on the compensation value loaded from the memory 20 to generate digital compensation data MDATA for compensating the threshold voltage (and/or mobility) of the driving TFT.

The compensation controller 111 controls the driving power to turn off when a normal off signal is input. The compensation controller 111 senses whether an off compensation signal OCS input through the source PCB 30 is activated or not before turning off the driving power, and updates the memory 20 each time the off compensation signal OCS is activated at the regular intervals.

The compensation value calculator 112 calculates a new compensation value with the passage of driving time by deriving a shift value with the passage of driving time with reference to the electrical characteristic value, i.e., sensed value, of the driving TFT input from the ADC and adding the shift value to a preset initial compensation value. Here, the electrical characteristic value may comprise at least either the threshold voltage value of the driving TFT or the mobility value of the driving TFT.

The compensation control signal generator 114 generates control signals related to compensation under control of the compensation controller 111. The compensation control signals may comprise a sensing signal SEN and a scan signal SCAN, as shown in FIG. 8.

FIG. 7 shows a connection structure between the timing controller 11, the data drive circuit 12, and the pixel P. FIG. 8 shows driving timing signals for compensated driving. FIG. 9 shows the waveforms of driving timing signals for normal driving.

Figure 8:
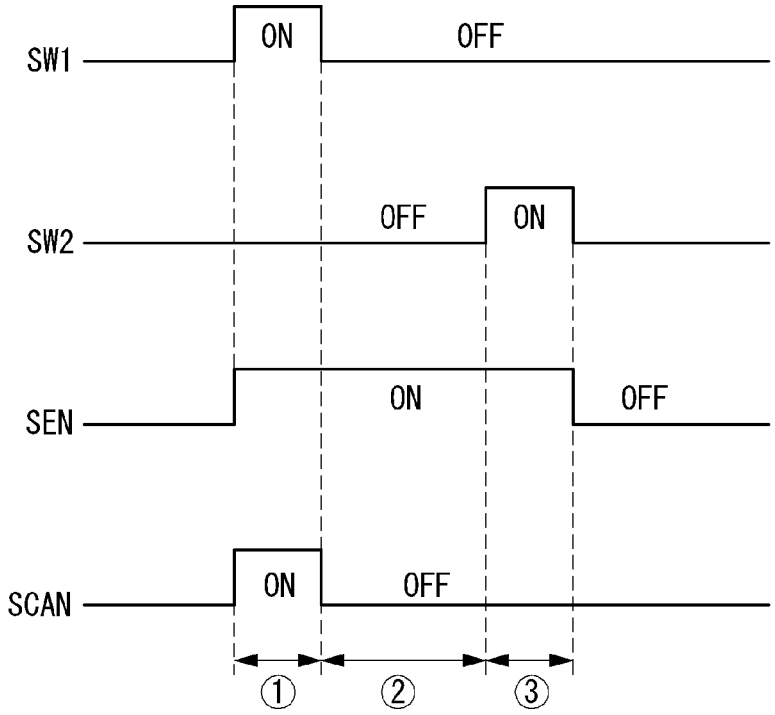
FIG. 8 is a view showing driving timing signals for compensated driving.
Figure 9:
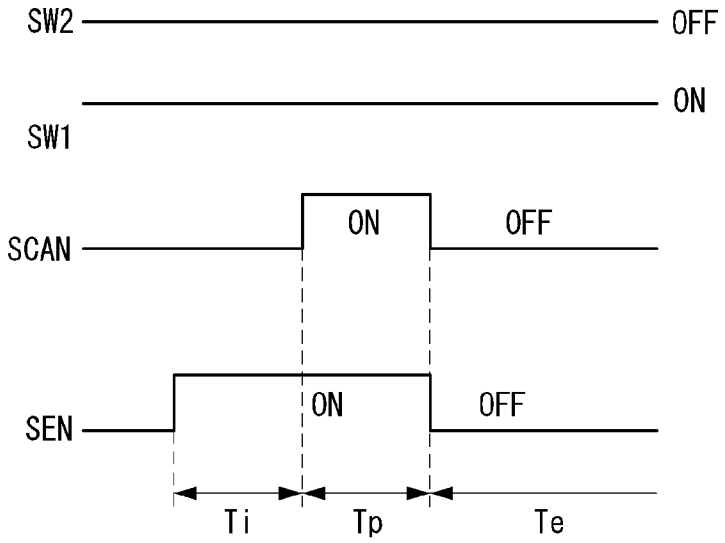
FIG. 9 is a view showing the waveforms of driving timing signals for normal driving.

Referring to FIGS. 7 and 8, the pixel P may comprise an OLED, a driving TFT DT, a storage capacitor Cst, a first switching TFT ST, and a second switching TFT ST2.

The OLED comprises an anode connected to a second node N2, a cathode connected to an input terminal of a low-potential driving voltage EVSS, and an organic compound layer located between the anode and the cathode.

The driving TFT DT controls the driving current Ioled flowing through the OLED in response to a gate-source voltage Vgs. The driving TFT DT comprises a gate electrode connected to a first node N1, a drain electrode connected to an input terminal of a high-potential driving voltage EVDD, and a source electrode connected to the second node N2.

The storage capacitor Cst is connected between the first node N1 and the second node N2.

The first switching TFT ST1 applies a data voltage Vdata on the data voltage supply line 14*a* to the first node N1 in response to a scan signal SCAN. The first switching TFT ST1 comprises a gate electrode connected to the scan control line 15*a*, a drain electrode connected to the data voltage supply line 14*a*, and a source electrode connected to the first node N1.

The second switching TFT ST2 stores a voltage charged in the second node N2 in a sensing capacitor Cx on the sensed voltage supply line 14*b* by switching the current flow between the second node N2 and the sensed voltage supply line 14*b* in response to a sensing signal SEN. The second switching TFT ST2 comprises a gate electrode connected to the sensing controller 15*b*, a drain electrode connected to the second node N2, and a source electrode connected to the sensed voltage supply line 14*b*.

The data drive circuit 12 is connected to the pixels P through the data voltage supply lines 14*a* and the sensed voltage supply lines 14*b*. A sensing capacitor Cx for storing a sensed voltage Vsen detected from each of the pixels P is formed in the sensed voltage supply line 14*b*.

The data drive circuit 12 comprises a digital-to-analog converter DAC, an analog-to-digital converter ADC, and first and second switches SW1 and SW2.

The DAC converts digital compensation data MDATA input from the timing controller 11 into an analog compensated data voltage Vdata and applies it to the data voltage supply lines 14*a*. The first switch SW1 switches the current flow between an initialization voltage (Vpre) input terminal and the sensed voltage supply lines 14*b*. The second switch SW2 switches the current flow between the sensed voltage supply lines 14*b* and the ADC. The ADC converts the analog sensed voltage Vsen stored in the sensing capacitor Cx into a digital sensed value and applies it to the timing controller 11.

A process of detecting a sensed voltage Vsen corresponding to the threshold voltage and/or mobility of the driving TFT DT of each pixel P will be further explained below with reference to FIG. 8.

The sensed voltage Vsen detected from each pixel P may correspond to the threshold voltage and/or mobility of the driving TFT DT.

The process of detecting a sensed voltage Vsen according to the present invention may be carried out in three steps, as shown in FIG. 8. During period ①, the first switching TFT ST1 is turned on to supply to the first node N1 a compensated data voltage Vdata reflecting a compensation value decided in the preceding period, and the first switch SW1 and the second switching TFT ST2 are turned on to supply an initialization voltage Vpres to the second node N2. At this time, the second switch SW2 is in the off state.

During period ②, the second switching TFT ST2 is kept turned on, and the others ST1, SW1, and SW2 are turned off. In this period, the potential of the second node N2 increases by the driving current Ioled flowing through the driving TFT DT, and the voltage charged in the second node N2 passes through the second switching TFT ST2 and is stored in the sensing capacitor Cx.

During period ③, the second switch SW2, is turned on, as well as the second switching TFT ST2. Accordingly, the voltage stored in the sensing capacitor Cx is sampled as a sensed voltage for the current period and passes through the ADC.

Such a sensing operation for compensated driving is performed upon activation of an off compensation signal OCS, simultaneously with the turn off of the driving power of the device in response to normal off signal input.

The present invention can freely increase sensing time without the user's being aware of it by setting the sensing timing for compensated driving during the off sequence. By thusly increasing the sensing time, sensing can be done relatively accurately even if the compensated data voltage applied to the pixels is scaled down and the driving current flowing through each pixel is reduced by 1/N. The present invention can detect sensed voltages Vsen with more accuracy than the prior art because stress put on the driving TFTs during a sensing operation can be greatly decreased.

A deterioration sensing operation for compensation value updates is performed during driving after product shipment, which is different from an initial sensing operation that is performed in a calibration process to obtain an initial compensation value before product shipment.

Meanwhile, normal driving for representing a normal image through video compensation data reflecting a compensation value is performed during the on sequence. Referring to FIG. 9, normal driving is performed in three stages: an initialization period Ti, a programming period Tp, and a light emission period Te, which are repeated every frame. On normal driving, the first switch SW1 of the data drive circuit 12 is constantly kept turned on, whereas the second switch SW2 is constantly kept turned off.

During the initialization period Ti, the second switching TFT ST2 is turned on to reset the second node N2 to the initialization voltage Vpre.

During the programming period Tp, the first switching TFT ST1 is turned on to supply to the first node N1 compensated data voltage MVdata for reducing electrical characteristic differences. At this time, the second node N2 maintains the initialization voltage Vpre through the second switching TFT ST2. Accordingly, the gate-source voltage Vgs of the driving TFT DT is programmed to a desired level during this period.

During the light emission period Te, the first and second switching TFTs ST1 and ST2 are turned off, and the driving TFT DT generates driving current Ioled at the programmed level and applies it to the OLED. The OLED displays a gray level by emitting light with a brightness corresponding to the driving current Ioled.

Figure 10A:
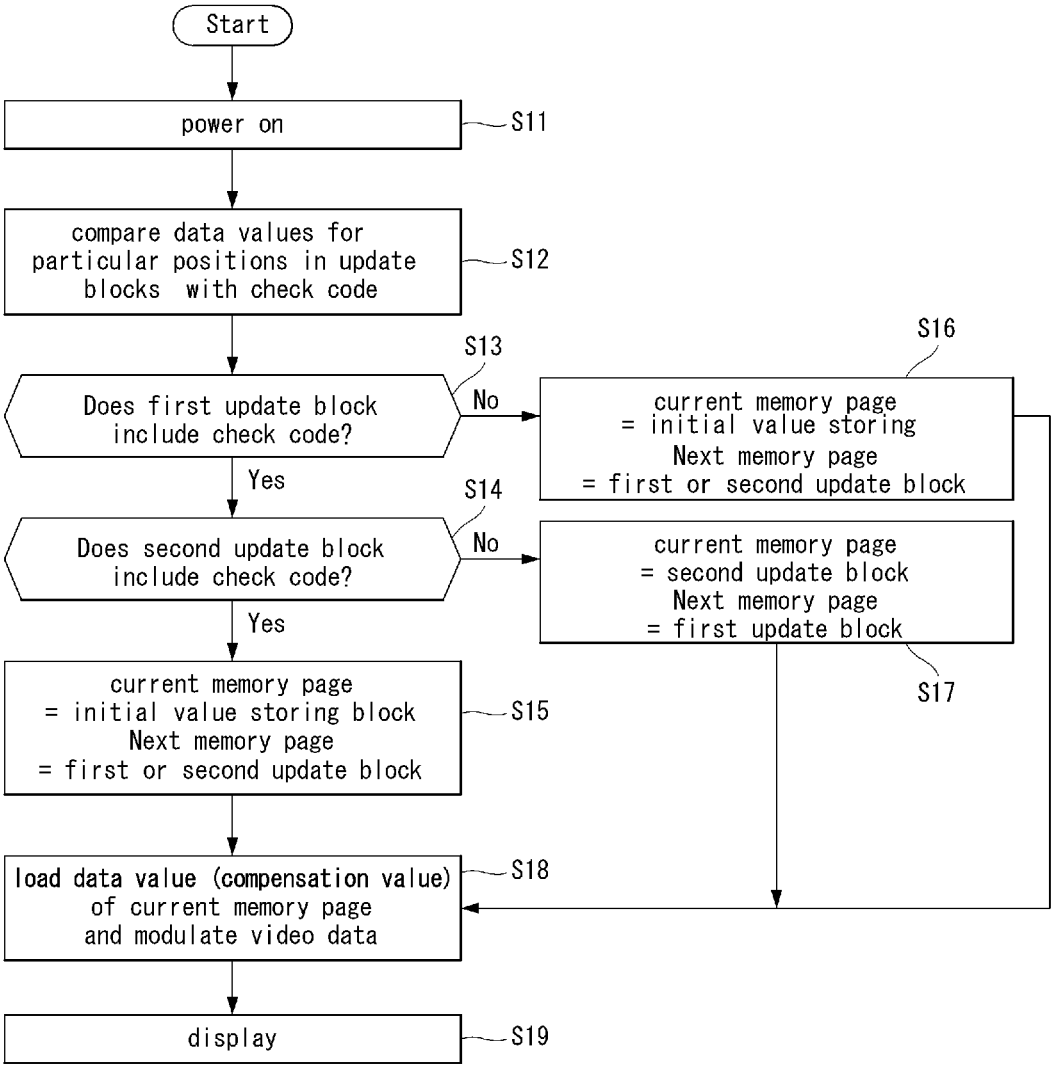
FIG. 10A is a view showing the on sequence during a deterioration compensation process according to the present invention.
Figure 10B:
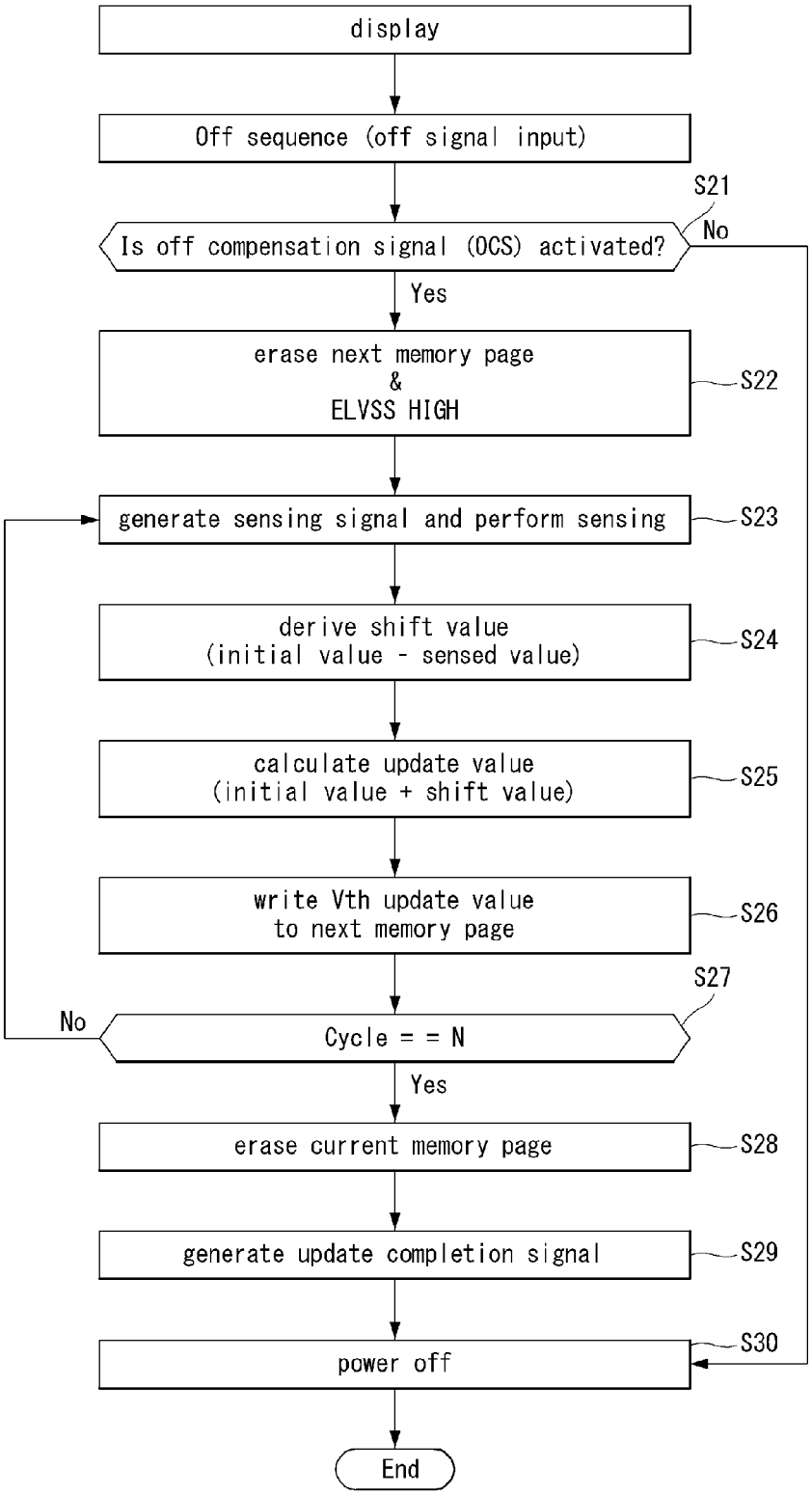
FIG. 10B is a view showing the off sequence during the deterioration compensation process according to the present invention.

FIG. 10A shows the on sequence during a deterioration compensation process according to the present invention. FIG. 10B shows the off sequence during the deterioration compensation process according to the present invention.

First of all, the on sequence will be described below with reference to FIG. 10A. In the on sequence, the current memory page for data loading and the next memory page for data writing are configured from among blocks divided from the memory, a compensation value is loaded from the block configured as the current memory page to modulate input video data, and a normal image is represented through video compensation data reflecting a compensation value.

In the present invention, when a power-on signal is input from the host system in response to the user's command, the data values for particular positions (storage lines in which data is written for the last time) in first and second update blocks of the memory are compared with a preset check code 'FF' (S11 and S12).

On first driving after product shipment, compensation data is stored in neither the memory's first update block nor the memory's second update block. Accordingly, the respective particular positions in the first and second update blocks represent the same data value as the check code. In the present invention, if the check code is included in respective particular positions in the first and second update blocks, an initial value storing block is configured as the current memory page, and either the first update block or the second update block is configured as the next memory page (S13, S14, and S15).

On second and subsequent driving after product shipment, unless an abnormal situation (e.g., a shutdown caused by a blackout) occurs, the compensation value written in the preceding period is normally stored in either the first update block or the second update block, (which results in a particular position having a different data value from the check code), while the compensation value is erased from the other update block, (which results in a particular position having the same data value as the check code). In an abnormal situation, the compensation value abnormally written in the preceding period is stored in either the first update block or the second update block, (which results in a particular position having the same data value as the check code), while the compensation value not erased in the preceding period is erased from the other update block, (which results in a particular position having a different data value from the check code).

Accordingly, the first update block and the second update block are configured to selectively include the check code at a particular position, making it easy to configure the current memory page and the next memory page according to the present invention.

Specifically, if the check code is not included in a particular position in the first update block, the first update block is configured as the current memory page and the second update block is configured as the next memory page according to the present invention (S16). On the contrary, if the check code is not included in a particular position in the second update block, the second update block is configured as the current memory page and the first update block is configured as the next memory page according to the present invention (S17).

Once the current memory page and the next memory page are configured, the compensation value stored in the current memory page is loaded to modulate input video data, and video compensation data reflecting a compensation value is applied to the display panel to represent a normal image (S18 and S19).

Next, the off sequence will be described below with reference to FIG. 10B. In the off sequence, the driving power is turned off in response to off signal input, and performs sensing and compensation value updating operations only when an off compensation signal OCS is activated.

In the present invention, when the off signal is input in response to the user's command, it is determined whether the off compensation signal OCS is activated or not, and if the off compensation signal OCS is not activated, skips the sensing and compensation value updating operations (S22 to S29) and turns off the driving power. On the other hand, in the present invention, if the off compensation signal OCS is activated, the sensing and compensation value updating operations (SS22 to S29) are performed.

The sensing and compensation value updating operations (SS22 to S29) will be described in detail. According to the present invention, the update block configured as the next memory page in the on sequence is erased to delete the compensation value incompletely written due to an abnormal termination in the preceding period. Also, a low-potential driving voltage is increased to a level (HIGH) for turning off the OLED so as to prevent unnecessary light emission of the OLED during the sensing process.

In the present invention, a compensation control signal (sensing signal, scan signal, etc) required for a sensing operation is generated, and the pixel is driven in response to the compensation control signal to obtain a sensed value related to the electrical characteristics (threshold voltage, mobility, etc) of the driving TFT (S23). Next, the sensed value is subtracted from a preset initial compensation value to derive a shift value corresponding to deterioration of the driving TFT (S24). Subsequently, the shift value is added to the preset initial compensation value to calculate an update value (new compensation value) for compensating for the deterioration of the driving TFT, and this update value is written to the update block configured as the next memory page (S25 and S26).

The above-described sensing and updating operations S23 to S26 are sequentially performed on all display lines of the display panel having a vertical resolution N (S27). After the compensation value for all the display lines is updated in the update block configured as the next memory page, the update block configured as the current memory page is erased, and then an update completion signal is generated (S28 and S29). Then, the driving power is turned off in response to the update completion signal (S30).

As described above in detail, according to the present invention, compensation data for driving deterioration after shipment is obtained by performing a sensing operation at regular intervals during the off sequence, and afterimages are prevented by updating the compensation data in the memory.

According to the present invention, the reliability of the memory is increased by storing compensation data to be updated at regular intervals alternately in the first update block and the second update block at the regular intervals. Particularly, the data values for particular positions in the first update block and the second update block are compared with a preset check code, and only normal compensation data is loaded and used for image representation, by which the prior art problem due to abnormal compensation data can be solved.

Moreover, if a high-potential driving voltage applied to the pixels drops to or below than a specified value, an abnormal signal is output to prevent abnormal data from being stored in the memory, resulting in solving the prior art problem.

From the above description, it will be apparent to those skilled in the art that various changes and modifications can be made without departing from the technical spirit of the present invention. Accordingly, the scope of the present invention should not be limited by the exemplary embodiments, but should be defined by the appended claims.

What is claimed is:

1. An image quality compensation device for an organic light emitting display, the device comprising:

a display panel having pixels arranged in a matrix form, each pixel having a driving transistor;

a data drive circuit configured to drive data signal lines;

a memory having first and second update blocks for selectively storing first and second period compensation values, which are sequentially updated at regular intervals, the memory further including an initial value storing block disposed between the first and second update blocks for storing a preset initial compensation value; and a timing controller configured to:

configure the first update block as either one of a current memory page for data loading or a next memory page for data writing and the second update block as the other of the two memory pages based on a preset check code, and update the memory by calculating the second period compensation value with a passage of driving time based on the first period compensation value loaded from the update block configured as the current memory page, writing the calculated second period compensation value to the update block configured as the next memory page, and then erasing the first period compensation value from the update block configured as the current memory page, wherein the second period compensation value is calculated by deriving a shift value with the passage of driving time with reference to electrical characteristic values of the driving transistor sensed by the data drive circuit and adding the shift value to the preset initial compensation value.

2. The image quality compensation device of claim 1, wherein the timing controller compares compensation values for particular positions in the first and second update blocks with the preset check code, and configures the update block in which a particular position has the same compensation value as the preset check code to be the next memory page and configures the update block in which a particular position has a different compensation value from the preset check code to be the current memory page.

3. The image quality compensation device of claim 2, wherein the preset check code is set to 'FF', and the particular positions are storage lines in which data is written for the last time in the first and second update blocks.

4. The image quality compensation device of claim 1, wherein a compensation writing order and a compensation erasing order are opposite in the first and second update blocks.

5. The image quality compensation device of claim 4, wherein, in the first and second update blocks, data is written from an uppermost storage line toward a lowermost storage line, and data is erased from the lowermost storage line toward the uppermost storage line.

6. The image quality compensation device of claim 2, wherein, in the first and second update blocks, the particular positions indicate the lowermost storage lines.

7. The image quality compensation device of claim 1, wherein the timing controller preliminarily erases an abnormal compensation value from the update block configured as the next memory page before re-writing the second period compensation value in the update block configured as the next memory page.

8. The image quality compensation device of claim 1, wherein the data drive circuit converts digital video compensation data input from the timing controller into a compensated data voltage, applies the compensated data voltage to the pixels of the display panel, and senses an electrical characteristic value of the driving TFT of each pixel.

9. The image quality compensation device of claim 8, wherein the timing controller modulates input digital video data based on the first period compensation value to generate the digital video compensation data, and calculates the second period compensation value by deriving a shift value with the passage of driving time with reference to the electrical characteristic value input from the data drive circuit and adding the shift value to the preset initial compensation value.

10. The image quality compensation device of claim 9, wherein the electrical characteristic value comprises at least either a threshold voltage value of the driving TFT or a mobility value of the driving TFT.

11. The image quality compensation device of claim 1, wherein the timing controller sets a data write address to other than particular positions in the first and second update blocks, in response to an abnormal signal.

12. The image quality compensation device of claim 1, wherein the timing controller controls a driving power to turn off when a normal off signal is input, senses whether an externally input off compensation signal is activated or not before turning off the driving power, and updates the memory each time the off compensation signal is activated at the regular intervals.

13. An image quality compensation method for an organic light emitting display including a display panel having pixels arranged in a matrix form, each pixel having a driving transistor, the method comprising:

preparing a memory having first and second update blocks for selectively storing first and second period compensation values, which are sequentially updated at regular intervals, the memory further including an initial value storing block disposed between the first and second update blocks for storing a preset initial compensation value;

configuring the first update block as either one of a current memory page for data loading or a next memory page for data writing and the second update block as the other one of the two memory pages based on a preset check code; and updating the memory by calculating the second period compensation value with a passage of driving time based on the first period compensation value loaded from the update block configured as the current memory page, writing the calculated second period compensation value to the update block configured as the next memory page, and then erasing the first period compensation value from the update block configured as the current memory page, wherein the second period compensation value is calculated by deriving a shift value with the passage of driving time with reference to electrical characteristic values of the driving transistor sensed by a data drive circuit and adding the shift value to the preset initial compensation value.

14. The image quality compensation method of claim 13, wherein the configuring comprises configuring the update block in which a particular position has the same compensation value as the preset check code to be the next memory page and configuring the update block in which a particular position has a different compensation value from the preset check code to be the current memory page.

15. The image quality compensation method of claim 14, wherein the preset check code is set to 'FF', and the particular positions are storage lines in which data is written for the last time in the first and second update blocks.

16. The image quality compensation method of claim 14, wherein a compensation writing order and a compensation erasing order are opposite in the first and second update blocks.

17. The image quality compensation method of claim 13, wherein the updating further comprises preliminarily erasing an abnormal compensation value from the update block configured as the next memory page before re-writing the second period compensation value in the update block configured as the next memory page.

18. The image quality compensation method of claim 13, wherein the updating further comprises:

modulating input digital video data based on the first period compensation value to generate a digital video compensation data;

converting the digital video compensation data input from the timing controller into a compensated data voltage, applying the compensated data voltage to the pixels of the display panel, and sensing an electrical characteristic value of the driving TFT of each pixel;

calculating the second period compensation value by deriving a shift value with the passage of driving time with reference to the electrical characteristic value input from the data drive circuit and adding the shift value to the preset initial compensation value.

19. The image quality compensation method of claim 18, wherein the electrical characteristic value comprises at least either a threshold voltage value of the driving TFT or a mobility value of the driving TFT.

20. The image quality compensation method of claim 13, wherein the updating further comprises setting data write address to other than particular positions in the first and second update blocks, in response to an abnormal signal.

21. The image quality compensation method of claim 13, wherein, in the updating, when a normal off signal is input, whether an externally input off compensation signal is activated or not is sensed before turning off a driving power, and the memory is updated each time the off compensation signal is activated at the regular intervals.

* * * * *